US012767195B2

(12) United States Patent
Hillabrand

(10) Patent No.: US 12,767,195 B2
(45) Date of Patent: Oct. 20, 2026

(54) SYSTEM AND METHOD FOR RAILWAY CROSSING DATA

(71) Applicant: Gregory James Hillabrand, Oregon, OH (US)

(72) Inventor: Gregory James Hillabrand, Oregon, OH (US)

( * ) Notice: Subject to any disclaimer, the term of this patent is extended or adjusted under 35 U.S.C. 154(b) by 10 days.

(21) Appl. No.: 19/038,166

(22) Filed: Jan. 27, 2025

(65) Prior Publication Data

US 2025/0242844 A1 Jul. 31, 2025

Related U.S. Application Data

(60) Provisional application No. 63/624,828, filed on Jan. 25, 2024.

(51) Int. Cl.
*B61L 23/06* (2006.01)

(52) U.S. Cl.
CPC ..... *B61L 23/06* (2013.01)

(58) Field of Classification Search
CPC ..... B61L 23/06; B61L 29/246; B61L 29/30
USPC ..... 701/19, 20
See application file for complete search history.

(56) References Cited

U.S. PATENT DOCUMENTS 8,838,301 B2 * 9/2014 Makkinejad ..... B61L 29/246 701/19
10,479,333 B2 * 11/2019 Weber ..... B60T 7/22
2013/0289805 A1 * 10/2013 Makkinejad ..... B61L 25/025 701/19
2015/0094949 A1 * 4/2015 Kato ..... G01C 21/3688 701/410

FOREIGN PATENT DOCUMENTS

CA 3047398 A1 * 6/2018 ..... G08G 1/08
CA 3127342 C * 5/2024 ..... B61L 25/021

* cited by examiner

*Primary Examiner* — Hai H Huynh
(74) *Attorney, Agent, or Firm* — Shumaker, Loop & Kendrick, LLP; James D. Miller

(57) ABSTRACT

Systems and methods for railway crossing data are provided. The method includes providing a computer with at least one processor and a memory device including readable instructions, and at least one user device in communication with the at least one processor via a network connection; receiving railway crossing data; storing the railway crossing data in at least one database; receiving at least one railway crossing data request; filtering the railway crossing data based on the at least one railway crossing data request; and transmitting a communication to the at least one user device in response to the at least one railway crossing data request.

16 Claims, 2 Drawing Sheets

SYSTEM AND METHOD FOR RAILWAY CROSSING DATA

CROSS-REFERENCE TO RELATED APPLICATION

This application claims the benefit of U.S. Provisional Patent Application Ser. No. 63/624,828, filed Jan. 25, 2024, the entirety of which is herein incorporated by reference.

FIELD

The present disclosure relates to a user software application, system, and method, and more particularly to a railway crossing application, system, and method for railway crossing data.

BACKGROUND

Despite the presence of automobiles and airplanes, railway trains still remain an important means of transportation for both passengers and cargo. Each day, thousands of trains travel across diverse routes and some over great distances along railroad tracks. While traveling these routes, trains may encounter numerous railroad crossings, or junctions where the railroad tracks intersect a roadway. In most cases, flashing lights, boom barriers, and other warning systems/devices are used to notify vehicles and pedestrians of approaching trains at a particular railroad crossing. However, the approximate arrival time of the train and the approximate duration for clearing these railroad crossings are not readily known in advance such that emergency, security, freight, passenger and other vehicles may plan alternate travel routes.

Emergency response services include fire, police, and paramedic services that typically are first responders to an incident and need to reach the locations of incidents as quickly as possible. These services generally have a central dispatching center. Dispatchers at these centers then direct emergency response vehicles such as an ambulance, fire engine, police car or other emergency vehicle to selected locations and/or street addresses.

Further, the rail crossings, have long presented a significant danger for vehicular traffic. Each year many car/train accidents occur at these locations.

Unreliability in warning systems such as lights and gates can cause rail crossing safety devices to be activated in error or even to fail to activate when necessary. Crossing safety devices can fail to activate due to contaminants, such as grease, that keep the train from completing the circuit. As a result, the signal indicating the presence of the train is not transmitted to the crossing.

Systems to address railroad safety are provided in U.S. Pat. Nos. 6,179,252; 8,838,301; and 10,648,827, the entire disclosures of each of which are incorporated herein by reference.

It would be desirable to have a system and method for railway crossing data which can provide real time updates to users with railway crossing status and other information to maximize safety and minimize travel time for the users.

SUMMARY

In concordance and agreement with the present disclosure, a system and method for railway crossing data which can provide real time updates to users with railway crossing status and other information to maximize safety and minimize travel time for the users, has been newly designed.

In one embodiment, a railway crossing data system, comprises: a computer with one or more processor and a memory device, wherein the computer executes computer-readable instructions for at least one interaction with at least one user device; and a network connection operatively connecting the at least one user device to the computer; wherein, upon execution of the computer-readable instructions, the computer is configured to: initiate providing, via a graphical user interface of the at least one user device, a railway crossing application to a user for installation on the at least one user device, wherein the at least one user device is configured to wirelessly communicate with the computer via the railway crossing application; receive, via the railway crossing application installed on the at least one user device, railway crossing data; store the railway crossing data in at least one database; receive, via the railway crossing application, at least one railway crossing data request; and transmit, via the railway crossing application, a communication to the at least one user device in response to the at least one railway crossing data request.

In another embodiment, a method for a railway crossing data system, comprises: providing a computer with one or more processor and a memory device, wherein the computer executes computer-readable instructions for at least one interaction with at least one user device, providing a network connection operatively connecting the at least one user device to the computer; providing, via a graphical user interface of the at least one user device, a railway crossing application to a user for installation on the at least one user device, wherein the at least one user device is configured to wirelessly communicate with the computer via the railway crossing application; receiving, via the railway crossing application installed on the at least one user device, railway crossing data; storing the railway crossing data in at least one database; receiving, via the railway crossing application, at least one railway crossing data request; and transmitting, via the railway crossing application, a communication to the at least one user device in response to the at least one railway crossing data request.

As aspects of some embodiments, upon execution of the computer-readable instructions, the computer is further configured to receive railway crossing data from a railway crossing device and/or a third party source.

As aspects of some embodiments, upon execution of the computer-readable instructions, the computer is further configured to filter the railway crossing data based on the at least one railway crossing data request.

As aspects of some embodiments, upon execution of the computer-readable instructions, the computer is further configured to filter the railway crossing data based on a route provided by a vehicle navigation system.

As aspects of some embodiments, the communication includes filtered railway crossing data.

As aspects of some embodiments, upon execution of the computer-readable instructions, the computer is further configured to transmit another communication to the at least one user device when a change in the previously transmitted railway crossing data has occurred.

As aspects of some embodiments, the railway crossing application is in communication with or includes a vehicle navigation system.

As aspects of some embodiments, the communication is received via the graphical user interface of the at least one user device.

As aspects of some embodiments, the communication is a graphical communication displayed on the graphical user interface of the at least one user device.

As aspects of some embodiments, the railway crossing data comprises a railway crossing status, the railway crossing status including open, closed, warning mode, malfunction, and/or duration of closure.

As aspects of some embodiments, the method further comprises receiving railway crossing data from a railway crossing device and/or a third party source.

As aspects of some embodiments, the method further comprises filtering the railway crossing data based on the at least one railway crossing data request.

As aspects of some embodiments, the method further comprises filtering the railway crossing data based on a route provided by a vehicle navigation system.

As aspects of some embodiments, the method further comprises transmitting another communication to the at least one user device when a change in the previously transmitted railway crossing data has occurred.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The above-mentioned, and other features and objects of the inventions, and the manner of attaining them will become more apparent and the invention itself will be better understood by reference to the following description of embodiments of the invention taken in conjunction with the accompanying drawings, wherein.

DETAILED DESCRIPTION

Figure 1:
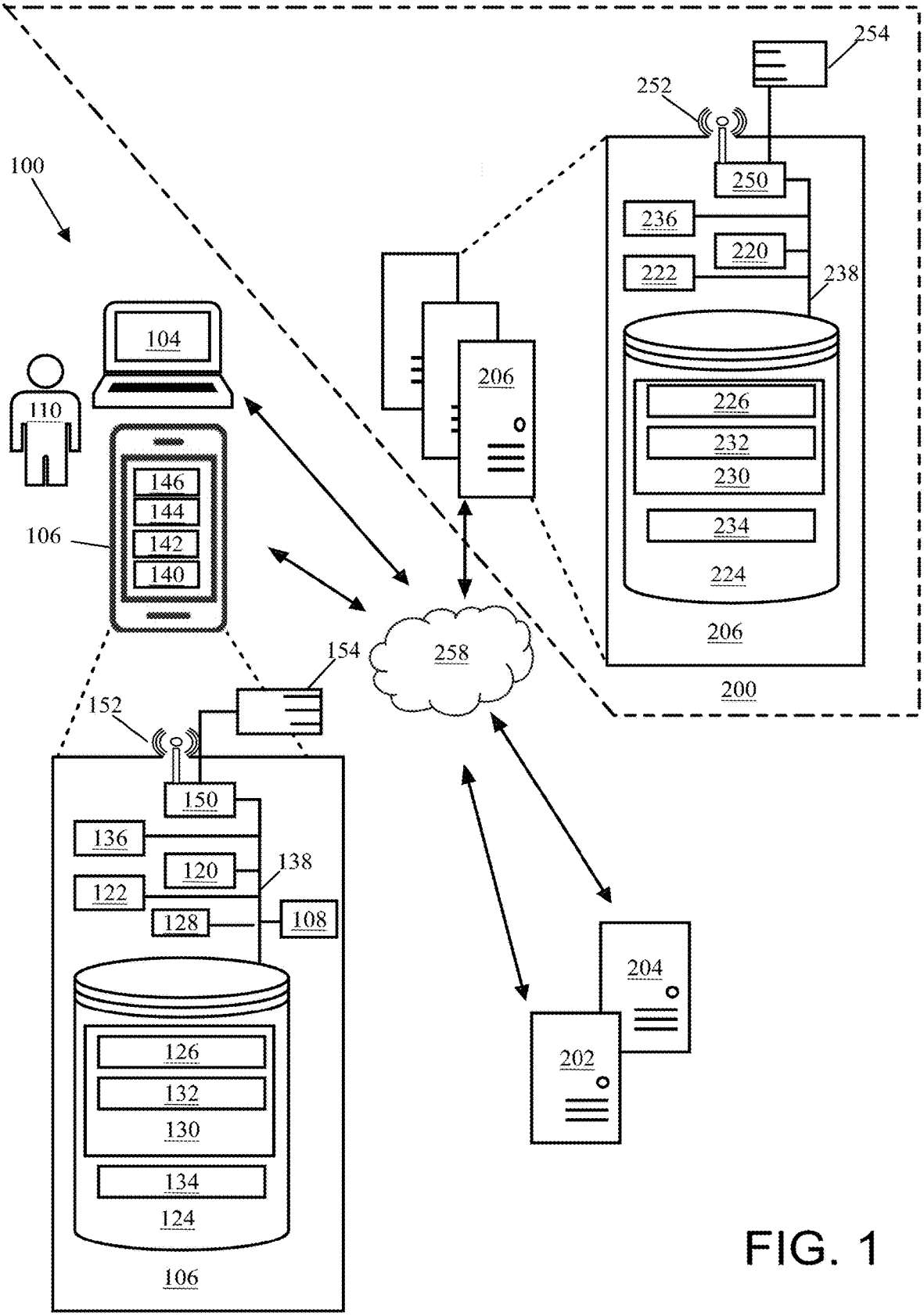
FIG. 1 is a schematic diagram illustrating a railway crossing system and environment thereof for implementing a railway crossing application in accordance with an embodiment of the presently described subject matter.

The following description of technology is merely exemplary in nature of the subject matter, manufacture and use of one or more embodiments of the present disclosure, and is not intended to limit the scope, application, or uses of any specific embodiment claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Embodiments of the present disclosure described herein, with reference to flowchart illustrations and/or block diagrams of methods or apparatuses (the term "apparatus" includes systems and computer program products), will be understood such that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a particular machine, such that the instructions, which execute via the processor of the computer or other programmable data processing apparatus, create mechanisms for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer readable memory produce an article of manufacture including instructions, which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions, which execute on the computer or other programmable apparatus, provide steps for implementing the functions/acts specified in the flowchart and/or block diagram block or blocks. Alternatively, computer program implemented steps or acts may be combined with operator or human implemented steps or acts in order to carry out an embodiment of the invention.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the herein described embodiments can be configured without departing from the scope and spirit of the invention. Therefore, it is to be understood that, within the scope of the included claims, the invention may be practiced other than as specifically described herein.

FIG. 1 illustrates a system 100 and environment thereof, according to at least one embodiment, by which a user 110 benefits through use of services and products of a railway crossing system 200. It should be appreciated that the term "railway", as used herein, represents a railway or railroad train having a connected set of vehicles configured to move along a track for transportation of freight and/or passengers from one place to another. The train may be a freight train, a monorail train, a high-speed rail train, a commuter train, a tram, a rubber-tired underground train, a Maglev train, or similar transport vehicle that travels along a railway and intersects a public roadway.

The environment may include, for example, a distributed cloud computing environment (private cloud, public cloud, community cloud, and/or hybrid cloud), an on-premise environment, fog computing environment, and/or an edge computing environment. The user 110 accesses services and products by use of one or more user devices, illustrated in separate examples as a computing device 104 and a mobile device 106, which may be, as non-limiting examples, a smart phone, a portable digital assistant (PDA), a pager, a mobile television, a gaming device, a laptop computer, a camera, a video recorder, an audio/video player, radio, a GPS device, or any combination of the aforementioned, or other portable device with processing and communication capabilities. In the illustrated example, the mobile device 106 is illustrated in FIG. 1 as having exemplary elements, the below descriptions of which apply as well to the computing device 104, which can be, as non-limiting examples, a desktop computer, a laptop computer, or other user-accessible computing device.

Furthermore, the user device, referring to either or both of the computing device 104 and the mobile device 106, may be or include a workstation, a server, or any other suitable device, including a set of servers, a cloud-based application or system, or any other suitable system, adapted to execute, for example any suitable operating system, including Linux, UNIX, Windows, macOS, IOS, Android and any other known operating system used on personal computers, central computing systems, phones, and other devices.

The user 110 can be an individual, a group, or any entity in possession of or having access to the user device, referring to either or both of the mobile device 104 and computing device 106, which may be personal or public items. Although the user 110 may be singly represented in some drawings, at least in some embodiments according to these descriptions the user 110 is one of many such that a community of users, consumers, customers, business entities, government entities, clubs, and groups of any size are all within the scope of these descriptions.

The user device, as illustrated with reference to the mobile device 106, includes components such as, at least one of each of a processing device 120, and a memory device 122 for processing use, such as random access memory (RAM), and read-only memory (ROM). The illustrated mobile device 106 further includes a storage device 124 including at least one of a non-transitory storage medium, such as a microdrive, for long-term, intermediate-term, and short-term storage of computer-readable instructions 126 for execution by the processing device 120. For example, the instructions 126 can include instructions for an operating system and various applications or programs 130, of which the application 132 is represented as a particular example. The storage device 124 can store various other data items 134, which can include, as non-limiting examples, cached data, user files such as those for pictures, audio and/or video recordings, files downloaded or received from other devices, and other data items preferred by the user or required or related to any or all of the applications or programs 130.

The memory device 122 is operatively coupled to the processing device 120. As used herein, memory includes any computer readable medium to store data, code, or other information. The memory device 122 may include volatile memory, such as volatile Random Access Memory (RAM) including a cache area for the temporary storage of data. The memory device 122 may also include non-volatile memory, which can be embedded and/or may be removable. The non-volatile memory can additionally or alternatively include an electrically erasable programmable read-only memory (EEPROM), flash memory or the like.

According to various embodiments, the memory device 122 and storage device 124 may be combined into a single storage medium. The memory device 122 and storage device 124 can store any of a number of applications which comprise computer-executable instructions and code executed by the processing device 120 to implement the functions of the mobile device 106 described herein. For example, the memory device 122 may include such applications as a conventional web browser application and/or a mobile P2P payment system client application. These applications also typically provide a graphical user interface (GUI) on the display 140 that allows the user 110 to communicate with the mobile device 106, and, for example a railway crossing data system, and/or other devices or systems. In one embodiment, when the user 110 decides to enroll in a mobile railway crossing program, the user 110 downloads or otherwise obtains the mobile railway crossing system client application from, for example, the railway crossing system 200, or from a distinct application server. In other embodiments, the user 110 interacts with the mobile railway crossing system via a web browser application in addition to, or instead of, the mobile railway crossing system client application.

The processing device 120, and other processors described herein, generally include circuitry for implementing communication and/or logic functions of the mobile device 106. For example, the processing device 120 may include a digital signal processor, a microprocessor, and various analog to digital converters, digital to analog converters, and/or other support circuits. Control and signal processing functions of the mobile device 106 are allocated between these devices according to their respective capabilities. The processing device 120 thus may also include the functionality to encode and interleave messages and data prior to modulation and transmission. The processing device 120 can additionally include an internal data modem. Further, the processing device 120 may include functionality to operate one or more software programs, which may be stored in the memory device 122, or in the storage device 124. For example, the processing device 120 may be capable of operating a connectivity program, such as a web browser application. The web browser application may then allow the mobile device 106 to transmit and receive web content, such as, for example, location-based content and/or other web page content, according to a Wireless Application Protocol (WAP), Hypertext Transfer Protocol (HTTP), and/or the like.

The memory device 122 and storage device 124 can each also store any of a number of pieces of information, and data, used by the user device and the applications and devices that facilitate functions of the user device, or are in communication with the user device, to implement the functions described herein and others not expressly described. For example, the storage device may include such data as user authentication information, railway crossing information, etc.

The processing device 120, in various examples, can operatively perform calculations, can process instructions for execution, and can manipulate information. The processing device 120 can execute machine-executable instructions stored in the storage device 124 and/or memory device 122 to thereby perform methods and functions as described or implied herein, for example by one or more corresponding flow charts expressly provided or implied as would be understood by one of ordinary skill in the art to which the subject matters of these descriptions pertain. The processing device 120 can be or can include, as non-limiting examples, a central processing unit (CPU), a microprocessor, a graphics processing unit (GPU), a microcontroller, an application-specific integrated circuit (ASIC), a programmable logic device (PLD), a digital signal processor (DSP), a field programmable gate array (FPGA), a state machine, a controller, gated or transistor logic, discrete physical hardware components, and combinations thereof. In some embodiments, particular portions or steps of methods and functions described herein are performed in whole or in part by way of the processing device 120, while in other embodiments methods and functions described herein include cloud-based computing in whole or in part such that the processing device 120 facilitates local operations including, as non-limiting examples, communication, data transfer, and user inputs and outputs such as receiving commands from and providing displays to the user 110.

The mobile device 106, as illustrated, includes an input and output system 136, referring to, including, or operatively coupled with, one or more user input devices and/or one or more user output devices, which are operatively coupled to the processing device 120. The input and output system 136 may include input/output circuitry that may operatively convert analog signals and other signals into digital data, or may convert digital data to another type of signal. For example, the input/output circuitry may receive and convert physical contact inputs, physical movements, or auditory signals (e.g., which may be used to authenticate a user) to digital data. Once converted, the digital data may be provided to the processing device 120. The input and output system 136 may also include a display 140 (e.g., a liquid crystal display (LCD), light emitting diode (LED) display, or the like), which can be, as a non-limiting example, a presence-sensitive input screen (e.g., touch screen or the like) of the mobile device 106, which serves both as an output device, by providing graphical and text indicia and presentations for viewing by one or more user 110, and as an input device, by providing virtual buttons, selectable options, a virtual keyboard, and other indicia that, when touched, control the mobile device 106 by user action. The user output devices include a speaker 144 or other audio device. The user input devices, which allow the mobile device 106 to receive data and actions such as button manipulations and touches from a user such as the user 110, may include any of a number of devices allowing the mobile device 106 to receive data from a user, such as a keypad, keyboard, touch-screen, touchpad, microphone 142, mouse, joystick, other pointer device, button, soft key, infrared sensor, and/or other input device(s). The input and output system 136 may also include a camera 146, such as a digital camera.

Further non-limiting examples of input devices and/or output devices include, one or more of each, any, and all of a wireless or wired keyboard, a mouse, a touchpad, a button, a switch, a light, an LED, a buzzer, a bell, a printer and/or other user input devices and output devices for use by or communication with the user 110 in accessing, using, and controlling, in whole or in part, the user device, referring to either or both of the computing device 104 and a mobile device 106. Inputs by one or more user 110 can thus be made via voice, text or graphical indicia selections. For example, such inputs in some examples correspond to user-side actions and communications seeking services and products of the railway crossing system 200, and at least some outputs in such examples correspond to data representing railway crossing information and communications in two-way communications between a user 110 and the railway crossing system 200.

The input and output system 136 may also be configured to obtain and process various forms of authentication via an authentication system to obtain authentication information of a user 110. Various authentication systems may include, according to various embodiments, a recognition system that detects biometric features or attributes of a user such as, for example fingerprint recognition systems and the like (hand print recognition systems, palm print recognition systems, etc.), iris recognition and the like used to authenticate a user based on features of the user's eyes, facial recognition systems based on facial features of the user, DNA-based authentication, or any other suitable biometric attribute or information associated with a user. Additionally or alternatively, voice biometric systems may be used to authenticate a user using speech recognition associated with a word, phrase, tone, or other voice-related features of the user. Alternate authentication systems may include one or more systems to identify a user based on a visual or temporal pattern of inputs provided by the user. For instance, the user device may display, for example, selectable options, shapes, inputs, buttons, numeric representations, etc. that must be selected in a pre-determined specified order or according to a specific pattern. Other authentication processes are also contemplated herein including, for example, email authentication, password protected authentication, device verification of saved devices, code-generated authentication, text message authentication, phone call authentication, etc. The user device may enable users to input any number or combination of authentication systems.

The user device, referring to either or both of the computing device 104 and the mobile device 106 may also include a positioning device 108, which can be for example a global positioning system device (GPS) configured to be used by a positioning system to determine a location of the computing device 104 or mobile device 106. For example, the positioning system device 108 may include a GPS transceiver. In some embodiments, the positioning system device 108 includes an antenna, transmitter, and receiver. For example, in one embodiment, triangulation of cellular signals may be used to identify the approximate location of the mobile device 106. In other embodiments, the positioning device 108 includes a proximity sensor or transmitter, such as an RFID tag, that can sense or be sensed by devices known to be located proximate a railway crossing or other location to determine that the consumer mobile device 106 is located proximate these known devices.

In the illustrated example, a system intraconnect 138, connects, for example electrically, the various described, illustrated, and implied components of the mobile device 106. The intraconnect 138, in various non-limiting examples, can include or represent, a system bus, a high-speed interface connecting the processing device 120 to the memory device 122, individual electrical connections among the components, and electrical conductive traces on a motherboard common to some or all of the above-described components of the user device (referring to either or both of the computing device 104 and the mobile device 106). As discussed herein, the system intraconnect 138 may operatively couple various components with one another, or in other words, electrically connects those components, either directly or indirectly—by way of intermediate component(s)—with one another.

The user device, referring to either or both of the computing device 104 and the mobile device 106, with particular reference to the mobile device 106 for illustration purposes, includes a communication interface 150, by which the mobile device 106 communicates and conducts transactions with other devices and systems. The communication interface 150 may include digital signal processing circuitry and may provide two-way communications and data exchanges, for example wirelessly via wireless communication device 152, and for an additional or alternative example, via wired or docked communication by mechanical electrically conductive connector 154. Communications may be conducted via various modes or protocols, of which GSM voice calls, SMS, EMS, MMS messaging, TDMA, CDMA, PDC, WCDMA, CDMA2000, and GPRS, are all non-limiting and non-exclusive examples. Thus, communications can be conducted, for example, via the wireless communication device 152, which can be or include a radio-frequency transceiver, a Bluetooth device, Wi-Fi device, a Near-field communication device, and other transceivers. In addition, GPS (Global Positioning System) may be included for navigation and location-related data exchanges, ingoing and/or outgoing. Communications may also or alternatively be conducted via the connector 154 for wired connections such by USB, Ethernet, and other physically connected modes of data transfer.

The processing device 120 is configured to use the communication interface 150 as, for example, a network interface to communicate with one or more other devices on a network. In this regard, the communication interface 150 utilizes the wireless communication device 152 as an antenna operatively coupled to a transmitter and a receiver (together a "transceiver") included with the communication interface 150. The processing device 120 is configured to provide signals to and receive signals from the transmitter and receiver, respectively. The signals may include signaling information in accordance with the air interface standard of the applicable cellular system of a wireless telephone network. In this regard, the mobile device 106 may be configured to operate with one or more air interface standards, communication protocols, modulation types, and access types. By way of illustration, the mobile device 106 may be configured to operate in accordance with any of a number of first, second, third, fourth, fifth-generation communication protocols and/or the like. For example, the mobile device 106 may be configured to operate in accordance with second-generation (2G) wireless communication protocols IS-136 (time division multiple access (TDMA)), GSM (global system for mobile communication), and/or IS-95 (code division multiple access (CDMA)), or with third-generation (3G) wireless communication protocols, such as Universal Mobile Telecommunications System (UMTS), CDMA2000, wideband CDMA (WCDMA) and/or time division-synchronous CDMA (TD-SCDMA), with fourth-generation (4G) wireless communication protocols such as Long-Term Evolution (LTE), fifth-generation (5G) wireless communication protocols, Bluetooth Low Energy (BLE) communication protocols such as Bluetooth 5.0, ultra-wide-band (UWB) communication protocols, and/or the like. The mobile device 106 may also be configured to operate in accordance with non-cellular communication mechanisms, such as via a wireless local area network (WLAN) or other communication/data networks.

The communication interface 150 may also include a network interface. The network interface may include software, such as encryption software, and hardware, such as a modem, for communicating information to and/or from one or more devices on a network. For example, the mobile device 106 may be configured so that it can be used, for example, to wirelessly communicate railway crossing operating states or other railway crossing information to a terminal of the network. Such communication could be performed via transmission over a wireless communication protocol such as the Near-field communication protocol.

The mobile device 106 further includes a power source 128, such as a battery, for powering various circuits and other devices that are used to operate the mobile device 106. Embodiments of the mobile device 106 may also include a clock or other timer configured to determine and, in some cases, communicate actual or relative time to the processing device 120 or one or more other devices. For further example, the clock may facilitate timestamping transmissions, receptions, and other data for security, authentication, logging, polling, data expiry, and forensic purposes.

System 100 as illustrated diagrammatically represents at least one example of a possible implementation, where alternatives, additions, and modifications are possible for performing some or all of the described methods, operations and functions. Although shown separately, in some embodiments, two or more systems, servers, or illustrated components may utilized. In some implementations, the functions of one or more systems, servers, or illustrated components may be provided by a single system or server. In some embodiments, the functions of one illustrated system or server may be provided by multiple systems, servers, or computing devices, including those physically located at a central facility, those logically local, and those located as remote with respect to each other.

The railway crossing system 200 can offer any number or type of services and products to one or more users 110. In some examples, a railway crossing system 200 offers products. In some examples, a railway crossing system 200 offers services. Use of "service(s)" or "product(s)" thus relates to either or both in these descriptions. With regard, for example, to online information and railway crossing services, "service" and "product" are sometimes termed interchangeably. In non-limiting examples, services and products include railway crossing services and products, information services and products, custom services and products, pre-defined or pre-offered services and products, consulting services and products, advising services and products, forecasting services and products, internet products and services, social media, and various other services and products, which may include, in non-limiting examples, services and products relating to railway crossing data.

To provide access to, or information regarding, some or all the services and products of the railway crossing system 200, automated assistance may be provided by the railway crossing system 200. For example, automated access to user accounts and replies to inquiries may be provided by railway crossing-side automated voice, text, and graphical display communications and interactions. In at least some examples, any number of human agents (not depicted), can be employed, utilized, authorized or referred by the railway crossing system 200. Such human agents can be, as non-limiting examples, representatives, online customer service assistants available to users 110, advisors, managers, and agents ready to route user requests and communications to preferred or particular other agents, human or virtual.

A computing system 206 of the railway crossing system 200 may include components such as, at least one of each of a processing device 220, and a memory device 222 for processing use, such as random access memory (RAM), and read-only memory (ROM). The illustrated computing system 206 further includes a storage device 224 including at least one non-transitory storage medium, such as a micro-drive, for long-term, intermediate-term, and short-term storage of computer-readable instructions 226 for execution by the processing device 220. For example, the instructions 226 can include instructions for an operating system and various applications or programs 230, of which the application 232 is represented as a particular example. The storage device 224 can store various other data 234, which can include, as non-limiting examples, cached data, and files such as those for user accounts, user profiles, and transaction histories, files downloaded or received from other devices, and other data items preferred by the user or required or related to any or all of the applications or programs 230.

The computing system 206, in the illustrated example, includes an input/output system 236, referring to, including, or operatively coupled with input devices and output devices.

In the illustrated example, a system intraconnect 238 electrically connects the various above-described components of the computing system 206. In some cases, the intraconnect 238 operatively couples components to one another, which indicates that the components may be directly or indirectly connected, such as by way of one or more intermediate components. The intraconnect 238, in various non-limiting examples, can include or represent, a system bus, a high-speed interface connecting the processing device 220 to the memory device 222, individual electrical connections among the components, and electrical conductive traces on a motherboard common to some or all of the above-described components of the user device.

The computing system 206, in the illustrated example, includes a communication interface 250, by which the computing system 206 communicates and conducts transactions with other devices and systems. The communication interface 250 may include digital signal processing circuitry and may provide two-way communications and data exchanges, for example wirelessly via wireless device 252, and for an additional or alternative example, via wired or docked communication by mechanical electrically conductive connector 254. Communications may be conducted via various modes or protocols, of which GSM voice calls, SMS, EMS, MMS messaging, TDMA, CDMA, PDC, WCDMA, CDMA2000, and GPRS, are all non-limiting and non-exclusive examples. Thus, communications can be conducted, for example, via the wireless device 252, which can be or include a radio-frequency transceiver, a Bluetooth device, Wi-Fi device, Near-field communication device, and other transceivers. In addition, GPS (Global Positioning System) may be included for navigation and location-related data exchanges, ingoing and/or outgoing. Communications may also or alternatively be conducted via the connector 254 for wired connections such as by USB, Ethernet, and other physically connected modes of data transfer.

The processing device 220, in various examples, can operatively perform calculations, can process instructions for execution, and can manipulate information. The processing device 220 can execute machine-executable instructions stored in the storage device 224 and/or memory device 222 to thereby perform methods and functions as described or implied herein, for example by one or more corresponding flow charts expressly provided or implied as would be understood by one of ordinary skill in the art to which the subjects matters of these descriptions pertain. The processing device 220 can be or can include, as non-limiting examples, a central processing unit (CPU), a microprocessor, a graphics processing unit (GPU), a microcontroller, an application-specific integrated circuit (ASIC), a programmable logic device (PLD), a digital signal processor (DSP), a field programmable gate array (FPGA), a state machine, a controller, gated or transistor logic, discrete physical hardware components, and combinations thereof.

Furthermore, the computing device 206, may be or include a workstation, a server, or any other suitable device, including a set of servers, a cloud-based application or system, or any other suitable system, adapted to execute, for example any suitable operating system, including Linux, UNIX, Windows, macOS, IOS, Android, and any known other operating system used on personal computer, central computing systems, phones, and other devices.

The user devices, referring to either or both of the computing device 104 and mobile device 106, and the railway crossing computing system 206, which may be one or any number centrally located or distributed, are in communication through one or more networks, referenced as network 258 in FIG. 1.

Network 258 provides wireless or wired communications among the components of the system 100 and the environment thereof, including other devices local or remote to those illustrated, such as additional mobile devices, servers, and other devices communicatively coupled to network 258, including those not illustrated in FIG. 1. The network 258 is singly depicted for illustrative convenience, but may include more than one network without departing from the scope of these descriptions. In some embodiments, the network 258 may be or provide one or more cloud-based services or operations. The network 258 may be or include a secured network, or may be implemented, at least in part, through one or more connections to the Internet. A portion of the network 258 may be a virtual private network (VPN) or an Intranet. The network 258 can include wired and wireless links, including, as non-limiting examples, 802.11a/b/g/n/ac, 802.20, WiMax, LTE, and/or any other wireless link. The network 258 may include any internal or external network, networks, sub-network, and combinations of such operable to implement communications between various computing components within and beyond the illustrated environment 100. The network 258 may communicate, for example, Internet Protocol (IP) packets, Frame Relay frames, Asynchronous Transfer Mode (ATM) cells, voice, video, data, and other suitable information between network addresses. The network 258 may also include one or more local area networks (LANs), radio access networks (RANs), metropolitan area networks (MANs), wide area networks (WANs), all or a portion of the internet and/or any other communication system or systems at one or more locations.

The network 258 may incorporate a cloud platform/data center that support various service models including Platform as a Service (PaaS), Infrastructure-as-a-Service (IaaS), and Software-as-a-Service (SaaS). Such service models may provide, for example, a digital platform accessible to the user device (referring to either or both of the computing device 104 and the mobile device 106). Specifically, SaaS may provide a user with the capability to use applications running on a cloud infrastructure, where the applications are accessible via a thin client interface such as a web browser and the user is not permitted to manage or control the underlying cloud infrastructure (i.e., network, servers, operating systems, storage, or specific application capabilities that are not user-specific). PaaS also do not permit the user to manage or control the underlying cloud infrastructure, but this service may enable a user to deploy user-created or acquired applications onto the cloud infrastructure using programming languages and tools provided by the provider of the application. In contrast, IaaS provides a user the permission to provision processing, storage, networks, and other computing resources as well as run arbitrary software (e.g., operating systems and applications) thereby giving the user control over operating systems, storage, deployed applications, and potentially select networking components (e.g., host firewalls).

The network 258 may also incorporate various cloud-based deployment models including private cloud (i.e., an organization-based cloud managed by either the organization or third parties and hosted on-premises or off premises), public cloud (i.e., cloud-based infrastructure available to the general public that is owned by an organization that sells cloud services), community cloud (i.e., cloud-based infrastructure shared by several organizations and manages by the organizations or third parties and hosted on-premises or off premises), and/or hybrid cloud (i.e., composed of two or more clouds e.g., private community, and/or public).

Two external systems 202 and 204 are expressly illustrated in FIG. 1, representing any number and variety of data sources, users, government entities, clubs, and groups of any size are all within the scope of the descriptions. In at least one example, the external systems 202 and 204 represent other railway crossing data source devices utilized by the railway crossing system 200 in serving the users 110. In other examples, the external systems 202 and 204 may be user devices of various other users 110 of the railway crossing system 200.

In certain embodiments, one or more of the systems such as the user device (referring to either or both of the computing device 104 and the mobile device 106), the railway crossing system 200, and/or the external systems 202 and 204 are, include, or utilize virtual resources. In some cases, such virtual resources are considered cloud resources or virtual machines. The cloud computing configuration may provide an infrastructure that includes a network of interconnected nodes and provides stateless, low coupling, modularity, and semantic interoperability. Such interconnected nodes may incorporate a computer system that includes one or more processors, a memory, and a bus that couples various system components (e.g., the memory) to the processor. Such virtual resources may be available for shared use among multiple distinct resource consumers and in certain implementations, virtual resources do not necessarily correspond to one or more specific pieces of hardware, but rather to a collection of pieces of hardware operatively coupled within a cloud computing configuration so that the resources may be shared as needed.

One of the programs 230 of the railway crossing system 200 may be a railway crossing application 232. The railway crossing application 232 may be used to provide the users 110 with current information related to specific railway crossings. In an embodiment, the railway crossing application 232 communicates railway crossing data to the user 110, including but not limited to, a railway crossing status.

In an embodiment, the railway crossing system 200 allows the users 110 to request railway crossing data via the railway crossing application 232. The railway crossing data may include information that can be used to assist the users 110 and/or help the users 110 to avoid certain railway crossing and/or surrounding areas thereof. For example, the railway crossing data may comprise a railway crossing status including, but not limited to, open, closed (due to an approaching/traversing train), caution in warning mode, malfunction at railway crossing, proceed with caution/use alternate route. The railway crossing data may also include and provide the user 110 with a duration of how long the railway crossing has been closed and/or if the train at the railway crossing is currently moving or stopped.

The railway crossing application 232 may receive one or more railway crossing data requests from a requestor. The requestor may be one of the users 110 or the agents of the railway crossing system 200. The railway crossing data may be provided by various data sources to the railway crossing application 232. Suppression rules and criteria are applied to the collected railway crossing data and the railway crossing data is suppressed, scrubbed, and/filtered. The filtered railway crossing data may then be outputted to the user 110 and/or stored by the railway crossing application 232 for fulfillment.

Operations of the method, and combinations of operation in the method, may be implemented by various means, such as hardware, firmware, processor, circuitry and/or other device associated with execution of software including one or more computer program instructions. For example, one or more of the procedures described in various embodiments may be embodied by computer program instructions. In an example embodiment, the computer program instructions, which embody the procedures, described in various embodiments may be stored by at least one memory device of a system and executed by at least one processor in the system. Any such computer program instructions may be loaded onto a computer or other programmable system (for example, hardware) to produce a machine, such that the resulting computer or other programmable system embody means for implementing the operations specified in the method.

Figure 2:
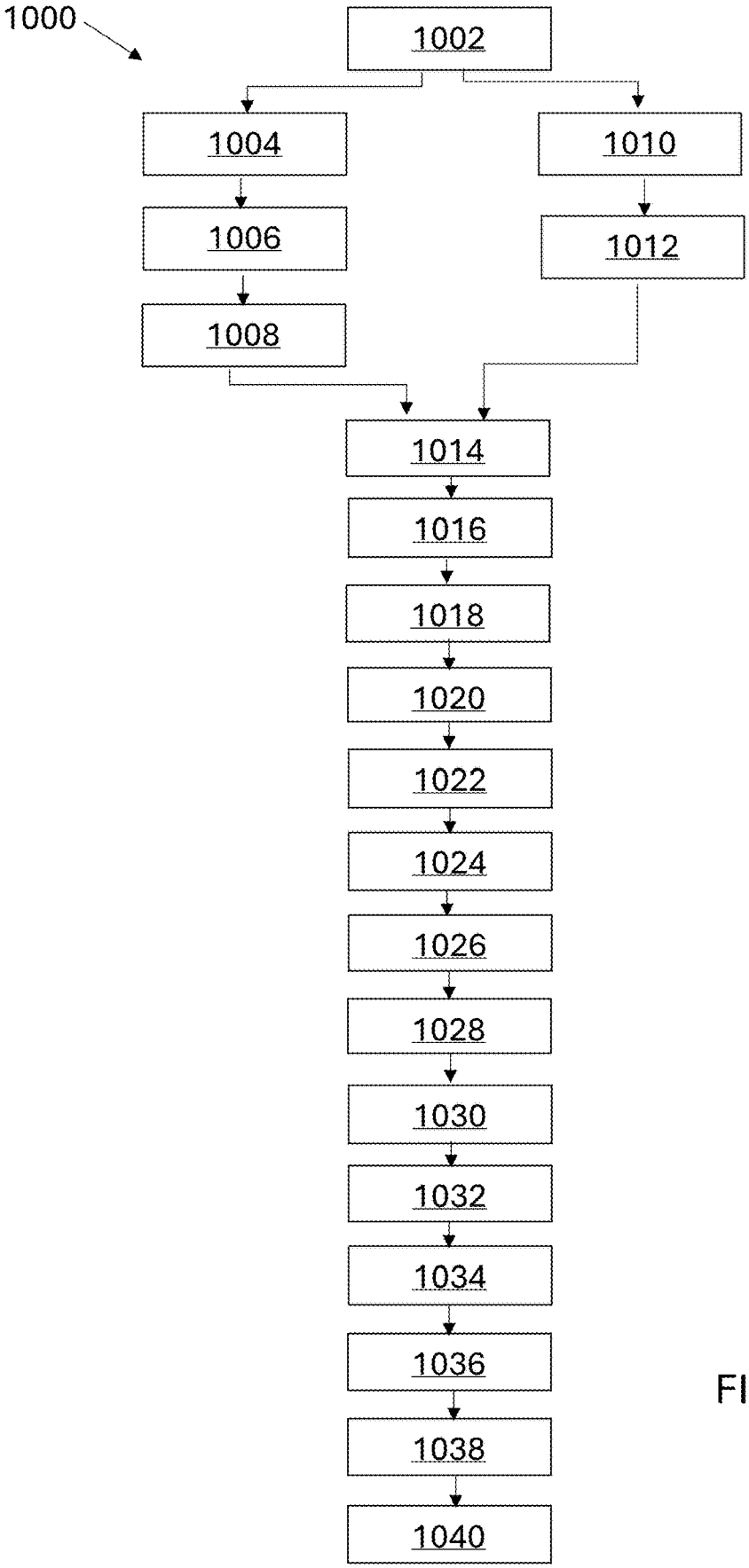
FIG. 2 is flow diagrams illustrating a method for requesting railway crossing data via the railway crossing application of FIG. 1.

FIG. 2 depicts an exemplary method 1000 employed for the railway crossing data requests. The method 1000 depicted may be executed by an application of a system, for example, the railway crossing application 232 of the railway crossing system 200 of FIG. 1. In an example embodiment, the railway crossing application 232 may be accessed via a graphical user interface (GUI) of a computing device, for example, the computing device 104 and/or the mobile device 106 of the user 110 of FIG. 1.

In some embodiments, the railway crossing application 232 allows the requestors, including the users 110 (e.g., authenticated and unauthenticated users) and/or the agents of the railway crossing system 200, to request and receive communications related to the railway crossing data. The authenticated users 110 may be an individual and/or entity that has an online user ID. The unauthenticated users 110 (e.g. guests) may be those without an online user ID or entirely new users of the railway crossing application 232.

In some embodiments, the method 1000 may include steps for initiating railway crossing data requests and/or controlling the railway crossing data received by the users 110. The railway crossing application 232 may utilize and/or be in communication with one or more data resources including but not limited to one or more railway crossing devices, other railway crossing systems, vehicle navigation applications and systems, global positioning applications and systems, third party applications and systems, and/or various other applications, devices, or systems directly or indirectly related to railway crossing data and information. It should be appreciated that the railway crossing application 232 may utilize more or less of the applications 230 and/or the systems 202, 204 of the railway crossing system 200.

In step 1002 of the method 1000, the user 110 executes the railway crossing application 232 using the user device, referring to either or both of the mobile device 104 and computing device 106. In step 1004, the user 110 inputs credentials into the railway crossing application 232. Once the railway crossing application 232 authenticates the credentials of the user 110, in step 1006, a personal dashboard may be provided at step 1008. The personal dashboard may include a personalized landing page of the user 110.

Alternatively, if the user 110 is not an authenticated user 110, the user 110 may login as an unauthenticated user or guest at step 1010. Similar to the login as the authenticated user, the railway crossing application 232 may require an input of certain credentials. When the user 110 is logged in as the unauthenticated user or guest, a generic dashboard may be provided to the user 110 at step 1012. The generic dashboard may include a generic landing page of the railway crossing application 232.

From the personal dashboard, in step 1008, or the generic dashboard, in step 1012, the user 110 may initiate a railway crossing data request in step 1014. When the railway crossing data request is initiated, the user 110, in step 1016, may receive a confirmation, for example, a confirmation page that the railway crossing data request has been submitted. In step 1018, an acknowledgement communication may be transmitted to the user 110. The acknowledgment communication may be automatically generated and sent to the user 110 and/or transmitted by various means such as by electronic mail, text, and the like, for example. Upon completion of the railway crossing data request, the user 110 may then close or logout of the railway crossing application 232. The railway crossing application 232 may then proceed to step 1020 as described hereinafter.

Once the railway crossing data request is initiated by the user 110 and/or verified by the railway crossing application 232, the railway crossing application 232 commences a collection of the railway crossing data, at step 1020.

The railway crossing data collection may be conducted by the railway crossing application 232 via the APIs or any other suitable means or method. In some instances, the railway crossing application 232, at step 1022, may be in communication with the various data resources as described hereinabove. For example, GPS information from train mounted devices as noted in the patents cited in the background can be used to automatically provide the information. In another non-limiting example, the information can also be provided by the users 110, wherein the user 110 interacts with the railway crossing application 232 to provide real time information regarding blocked crossings. The user 110 may select a menu notification button, wherein the user 110 then enters the information to the railway crossing application 232. At step 1024, one or more of the data resources may transmit the collected railway crossing data to the railway crossing application 232. The collected railway crossing data may be communicated via the APIs or any other suitable means or method.

The railway crossing data received by the railway crossing application 232 may be filtered at step 1026. In some embodiments, the railway crossing data is filtered based on the at least one railway crossing data request and/or an intended/actual travel route provided by a vehicle navigation system. It should be appreciated that the railway crossing data may be filtered based on other user-specific information and/or preferences and/or requests received by the railway crossing application 232. An external facing taxonomy (EFT tool) may be employed to conduct the filtering of the collected railway crossing data. In certain embodiments, the collected railway crossing data may be compared to predetermined rules and/or criteria to delete unnecessary and/or undesired segments of the railway crossing data.

At step 1028, the filtered railway crossing data is transformed by the railway crossing application 232 into a communication (e.g., an electronic message or file, a graphical communication, an audio communication, a visual communication, and the like) containing the filtered railway crossing data. For example, the communication may be a text message, or a graphical indicium that appears within a vehicle navigation application or system.

When the communication containing the filtered railway crossing data is completed, the communication containing the filtered railway crossing data may then be transmitted directly or indirectly to the user 110 via the railway crossing application 232 at step 1030. For example, the communication may be transmitted directly to the user 110 via electronic mail, text, or the graphical user interface of the user device, referring to either or both of the mobile device 104 and computing device 106 and/or hosted on the personal dashboard of the user 110 by the railway crossing application 232.

When the user 110 is determined to have a login to the railway crossing application at step 1030, either by being an authenticated user 110 or an agent, a communication maybe directly transmitted thereto. In some embodiments, the communication may contain the filtered railway crossing data may be transmitted via electronic mail or text and/or may contain a link to log into the railway crossing application 232 and view the communication containing the filtered railway crossing data on the personal or generic dashboard at step 1032. Upon transmittal of the electronic mail or text containing the link, the railway crossing application 232 is ended at step 1034.

At step 1036, the authenticated or unauthenticated user 110 may use the link in the communication to log into the railway crossing application 232 and view the communication containing the filtered railway crossing data. Once the user 110 has viewed such communication, the railway crossing application is ended at step 1038.

In an embodiment, the railway crossing system 200 may be caused to transmit a communication containing the filtered railway crossing data based at least on one of a plurality of preconfigured rules and criteria. In an embodiment, the plurality of preconfigured rules and criteria may be defined based on a user input, a user location, an intended or actual travel route of the user, and/or various other inputs and information. In some embodiments, the railway crossing system 200, via the railway crossing application 232, may be caused to transmit another communication to the user device, referring to either or both of the mobile device 104 and computing device 106, when a change in the previously transmitted railway crossing data has occurred. Such communication may result from another railway crossing data request by the user 110 and/or automatically by the railway crossing application 232.

Since the railway crossing system 200 is extensible and flexible, the communications containing the filtered railway crossing data defined herein are not static, and can be updated by adding, deleting, and/or replacing rules and criteria.

The use of the railway crossing application 232 improves the efficiency of the users 110 and operation of the computing system 206 in various different respects. First, the disclosed method eliminates unnecessary time, effort, and communications relating to certain tasks performed by the user 110 and/or the computing system 206 that have been found to not have a positive impact on securing the railway crossing data from the various data resources. This may be especially relevant where extensive costs can be avoided by verifying requestor credentials and filtering the railway crossing data prior to transmittal of any communication. This results in the users 110 and the computing system 206 avoiding a waste of resources when performing certain tasks. Second, the use of the railway crossing application 232 also allows for the computing system 206 to be simplified by means of the elimination of undesired interactions. Third, the railway crossing application 232 provides greater insight to the users 110 with respect to railway crossing data by the railway crossing system 200, which maximize safety and minimize travel time for the users 110.

Each of the described advantages reduces network traffic as experienced by the computing system 206 due to the ability to initiate a railway crossing data request via the railway crossing application via the graphical user interface.

As part of the railway crossing application 232, the railway crossing data may comprise information on trains including closed/blocked railway crossings. This may be done graphically, wherein the closed/blocked railway crossing appears on a map displayed on the user device, referring to either or both of the mobile device 104 and computing device 106. Audible notifications can also be provided such as by voice or other sounds, which gain the attention of the user 110. Further, the railway crossing data can be used to alter turn by turn navigation directions to assist the user 110 in avoiding closed/blocked railway crossings. The user 110 may be a driver of a passenger vehicle, an emergency responder, a bus driver, a truck driver, and the like.

Features of the railway crossing application 232 are expandable as user expectations and privacy regulations evolve over time.

The application is anticipated to be distributed as a free application, with the money generated by advertising.

From the foregoing description, one ordinarily skilled in the art can easily ascertain the essential characteristics of this disclosure and, without departing from the spirit and scope thereof, can make various changes and modifications to the embodiments of the present disclosure to adapt it to various usages and conditions.

What is claimed is:

1. A railway crossing data system, comprising:

a computer with one or more processor and a memory device, wherein the computer executes computer-readable instructions for at least one interaction with at least one user device; and a network connection operatively connecting the at least one user device to the computer;

wherein, upon execution of the computer-readable instructions, the computer is configured to:

initiate providing, via a graphical user interface of the at least one user device, a railway crossing application to a user for installation on the at least one user device, wherein the at least one user device is configured to wirelessly communicate with the computer via the railway crossing application;

receive, via the railway crossing application installed on the at least one user device, railway crossing data;

store the railway crossing data in at least one database;

receive, via the railway crossing application, at least one railway crossing data request; and transmit, via the railway crossing application, a communication to the at least one user device in response to the at least one railway crossing data request, wherein, upon execution of the computer-readable instructions, the computer is further configured to filter the railway crossing data based on at least one of the at least one railway crossing data request and a route provided by a vehicle navigation system.

2. The system of claim 1, wherein, upon execution of the computer-readable instructions, the computer is further configured to receive railway crossing data from a railway crossing device and/or a third party source.

3. The system of claim 1, wherein, upon execution of the computer-readable instructions, the computer is further configured to transmit another communication to the at least one user device when a change in the previously transmitted railway crossing data has occurred.

4. The system of claim 1, the railway crossing application is in communication with or includes a vehicle navigation system.

5. The system of claim 1, wherein the communication is received via the graphical user interface of the at least one user device.

6. The system of claim 1, wherein the communication is a graphical communication displayed on the graphical user interface of the at least one user device.

7. The system of claim 1, wherein the railway crossing data comprises a railway crossing status, the railway crossing status including open, closed, warning mode, malfunction, and/or duration of closure.

8. A railway crossing data system, comprising:

a computer with one or more processor and a memory device, wherein the computer executes computer-readable instructions for at least one interaction with at least one user device; and a network connection operatively connecting the at least one user device to the computer;

wherein, upon execution of the computer-readable instructions, the computer is configured to:

initiate providing, via a graphical user interface of the at least one user device, a railway crossing application to a user for installation on the at least one user device, wherein the at least one user device is configured to wirelessly communicate with the computer via the railway crossing application;

receive, via the railway crossing application installed on the at least one user device, railway crossing data;

store the railway crossing data in at least one database;

receive, via the railway crossing application, at least one railway crossing data request; and transmit, via the railway crossing application, a communication to the at least one user device in response to the at least one railway crossing data request, wherein the communication includes filtered railway crossing data.

9. A method for a railway crossing data system, comprising:

providing a computer with one or more processor and a memory device, wherein the computer executes computer-readable instructions for at least one interaction with at least one user device, providing a network connection operatively connecting the at least one user device to the computer;

providing, via a graphical user interface of the at least one user device, a railway crossing application to a user for installation on the at least one user device, wherein the at least one user device is configured to wirelessly communicate with the computer via the railway crossing application;

receiving, via the railway crossing application installed on the at least one user device, railway crossing data;

storing the railway crossing data in at least one database;

receiving, via the railway crossing application, at least one railway crossing data request; and transmitting, via the railway crossing application, a communication to the at least one user device in response to the at least one railway crossing data request, further comprising filtering the railway crossing data based on at least one of the at least one railway crossing data request and a route provided by a vehicle navigation system.

10. The method of claim 9, further comprising receiving railway crossing data from a railway crossing device and/or a third party source.

11. The method of claim 9, further comprising transmitting another communication to the at least one user device when a change in the previously transmitted railway crossing data has occurred.

12. The method of claim 9, the railway crossing application is in communication with or includes a vehicle navigation system.

13. The method of claim 9, wherein the communication is received via the graphical user interface of the at least one user device.

14. The method of claim 9, wherein the communication is a graphical communication displayed on the graphical user interface of the at least one user device.

15. The method of claim 9, wherein the railway crossing data comprises a railway crossing status, the railway crossing status including open, closed, warning mode, malfunction, and/or duration of closure.

16. A method for a railway crossing data system, comprising:

providing a computer with one or more processor and a memory device, wherein the computer executes computer-readable instructions for at least one interaction with at least one user device, providing a network connection operatively connecting the at least one user device to the computer;

providing, via a graphical user interface of the at least one user device, a railway crossing application to a user for installation on the at least one user device, wherein the at least one user device is configured to wirelessly communicate with the computer via the railway crossing application;

receiving, via the railway crossing application installed on the at least one user device, railway crossing data;

storing the railway crossing data in at least one database;

receiving, via the railway crossing application, at least one railway crossing data request;

and transmitting, via the railway crossing application, a communication to the at least one user device in response to the at least one railway crossing data request, wherein the communication includes filtered railway crossing data.

* * * * *